US005984120A

United States Patent [19]

Johnske

[11] Patent Number: 5,984,120

[45] Date of Patent: Nov. 16, 1999

[54] POINT-OF-PURCHASE DISPLAY SYSTEM AND METHOD FOR FORMATION THEREOF

[75] Inventor: David A. Johnske, Bolingbrook, Ill.

[73] Assignee: Stone Container Corporation, Chicago, Ill.

[21] Appl. No.: 09/045,089

[22] Filed: Mar. 20, 1998

[51] Int. Cl.[6] ..... A47F 5/00

[52] U.S. Cl. ..... 211/132.1; 211/126.16; 248/174

[58] Field of Search ..... 211/72, 73, 126.16, 211/132.1, 126.2; 248/174; 229/120.06, 120.26

[56] References Cited

U.S. PATENT DOCUMENTS

| | | | |
|---|---|---|---|
| 2,135,093 | 11/1938 | Abrams | 248/174 |
| 3,164,350 | 1/1965 | Taub | 248/174 |
| 3,862,689 | 1/1975 | Taub | 211/126.16 X |
| 3,999,662 | 12/1976 | Barnhardt | 248/174 X |
| 4,753,341 | 6/1988 | McIntyre | 248/174 X |
| 4,911,311 | 3/1990 | Nagai | 248/174 X |
| 4,991,804 | 2/1991 | Iannucci | 211/132.1 X |
| 5,213,220 | 5/1993 | McBride | 248/175 X |
| 5,758,783 | 6/1998 | Maglione | 211/126.16 X |
| 5,826,732 | 10/1998 | Ragsdale | 248/174 X |

*Primary Examiner*—Robert W. Gibson, Jr.
*Attorney, Agent, or Firm*—Dick and Harris

[57] ABSTRACT

A point-of-purchase display system for shipping and displaying articles therewithin, the display system utilizes facilitated articulation while maximizing display area, and the display system comprises at least one modular tray member. The at least one modular tray member includes an inner liner having a tray support member and a tray divider member for securing and displaying articles therein. An outer tray is operably associated with the inner liner, and the outer tray has a bottom panel, a back panel, and two side panels. Each of the side panels includes a biasable flap, which, upon articulation, covers the exposed side wall edges of both the outer tray and inner liner. Each biasable flap includes a locking tab for operably engaging a tab locking slot on the bottom panel to secure the biasable flap therein. The invention further includes a method for forming a point-of-purchase display system for shipping and displaying articles therewithin.

49 Claims, 9 Drawing Sheets

POINT-OF-PURCHASE DISPLAY SYSTEM AND METHOD FOR FORMATION THEREOF

BACKGROUND OF THE DISCLOSURE

The present invention is directed to a point-of-purchase display system and, more particularly to a point-of-purchase display system comprising at least one system member which is used to ship and/or display articles therewithin, such as videotapes. The present invention is also directed to a method for forming a point-of-purchase display system for shipping and displaying articles therewithin.

One and two-piece point-of-purchase display systems formed of corrugated paperboard are well-known in the art, particularly for shipping and displaying videotape cassette products. Traditionally, two-piece display systems (as shown in FIGS. 17–19) have comprised an outer tray and an inner divider, similar to produce packaging. However, these two-piece systems do not always possess significant stacking strength, and thus, articles therein can be damaged when vertically stacked in such display systems. Also, usually exposed edges on the display systems are visible to the consumer, and therefore, are not aesthetically pleasing to the consumer. Further, such two-piece systems typically require more material, and accordingly, are not always economical.

To reduce display system costs, one-piece displays (as shown in FIGS. 1 and 2) have been utilized. These displays have usually been strong enough to support and protect the articles therein during shipment, as well as have been capable of presenting the articles for point-of-purchase display in a video store. Exposed corrugated edges are often covered, through overlay or encirclement, so that these displays can be aesthetically pleasing to the consumer. However, covering exposed corrugated edges typically requires additional material, and additional folds. Accordingly, these one-piece prior art displays often do not provide the most economical use of corrugated paperboard, per article being displayed. The present invention accordingly represents a significant savings of corrugated paperboard, per article displayed, over the prior art one-piece display system, currently utilized in the marketplace.

It is therefore an object of the present invention to provide an economical display system that provides for the aesthetic presentation of articles therewithin.

It is also an object of the present invention to provide a display system that possesses maximum stacking strength to accommodate vertically stackable orientation thereof.

It is a further object of the present invention to provide a display system that requires minimal assembly prior to point-of-purchase display in the store.

It is yet another object of the present invention to provide a display system that maximizes shipping space, while enhancing stacking strength and preventing articles from shifting during shipment.

These and other objects of the invention will become apparent in light of the present specification, claims and drawings.

SUMMARY OF THE INVENTION

The invention comprises a point-of-purchase display system for shipping and displaying articles therewithin; in which the display system utilizes facilitated articulation while maximizing display area. In particular, the display system is preferably formed of corrugated paperboard and comprises at least one modular tray member. In one preferred embodiment, each modular tray member is substantially identical, and comprises an inner liner and an outer tray.

In this embodiment, the inner liner includes a tray support member and a tray divider member for securing and displaying articles therewithin. The tray support member has a middle region and two side regions. The tray divider member includes at least one divider panel. Preferably, the tray divider member has two tray divider panels.

The outer tray co-operates with the inner liner to describe an indexed or divided containment region. The outer tray has a bottom panel, a back panel, and two side panels. The two side panels and the back panel have a height substantially equal to the height of the inner liner to form integrated side and back walls respectively, which provide maximum stacking strength to the modular tray members. Further, each of the side panels includes a biasable flap, which, upon articulation, covers the exposed side wall edges of both the outer tray and inner liner. Each biasable flap includes a locking tab for engaging a tab locking slot on the bottom panel to secure the biasable flap therein.

In this embodiment, the tray support member includes at least one stacking tab for engaging a tab stacking slot on a successively higher one of the modular tray members. Preferably, the tray support member has three stacking tabs capable of releasable mating engagement with three tab stacking slots respectively on a successively higher one of the modular tray members.

In this embodiment, the outer tray is self-erecting and collapsible prior to loading for, in turn, shipment and display in a store. Moreover, the bottom panel includes a plurality of tab stacking slots capable of releasable mating engagement with a plurality of stacking tabs on a successively higher one of the modular tray members.

Additionally, the side panels each include a side-front flap, which, upon articulation and engagement with the front panel, secures the front panel to the side panel. Each of the side panels further includes a side-back flap, which co-operates with the back panel, and provides structural support to the outer tray. Back panel includes two angled fold lines which enable the outer tray to be self-erecting and collapsible.

In this embodiment, each modular tray member includes a front panel. The front panel includes two locking tabs for engaging two tab locking slots on the bottom panel to secure the front panel therein. The front panel further includes a fold line and at least one locking tab for inward articulation. Once inwardly articulated, the front panel is engaged and secured to the bottom panel.

In this embodiment, the display system includes a base having four flaps which are folded inwardly to form at least a double sidewall support. Moreover, the system includes a pallet skirt having four flaps for substantially overlapping the sides of a support pallet when the flaps are articulated. The display system also includes a joiner member capable of releasable mating engagement with at least one modular tray member; to, in turn, lend structural support and stacking strength to the display system and facilitate vertically stackable orientation thereof.

In another embodiment, the display system utilizes facilitated articulation while maximizing display area. In particular, the display system is preferably formed of corrugated paperboard and comprises at least one modular tray member. In this embodiment, each modular tray member is substantially identical.

Each modular tray member comprises an outer tray having a bottom panel, a back panel, and two side panels. The outer tray includes at least one stacking tab for engaging and securing a tab stacking slot on a successively higher one of the modular tray members. In this embodiment, the outer tray has three stacking tabs capable of releasable mating engagement with three tab stacking slots respectively on a successively higher one of the modular tray members.

In this embodiment, the display system includes a base having four flaps which are folded inwardly to form at least a double sidewall support. Moreover, the display system includes a pallet skirt having four flaps for substantially overlapping sides of a pallet when the flaps are articulated. The display system also includes a joiner member capable of releasable mating engagement with at least one modular tray member; to, in turn, lend structural support and stacking strength to the display system and facilitate vertically stackable orientation thereof.

In this embodiment, the bottom panel includes a plurality of tab stacking slots capable of releasable mating engagement with a plurality of stacking tabs on a successively higher one of the modular tray members. The back panel includes two angled fold lines which enable the outer tray to be self-erecting and collapsible.

Each of the side panels includes a biasable flap, which, upon articulation, covers the exposed side panel edges of the outer tray. Further, each biasable flap is substantially triangular, and includes a locking tab for engaging a tab locking slot on the bottom panel to secure the biasable flap therein. Each of the side panels further includes a side-front flap, which, upon articulation and engagement with the front panel, secures the front panel to the side panels. Moreover, each of the side panels includes a side-back flap, which is co-operates with the back panel, and provides structural support to the outer tray.

In this preferred embodiment, each modular tray member includes a front panel. The front panel includes a fold line and at least one locking tab for inward articulation. Once inwardly articulated, the front panel is engaged and secured to the bottom panel. The front panel further includes two locking tabs for engaging and securing two tab locking slots on the bottom panel to secure the front panel therein.

In yet another embodiment, the display system utilizes facilitated articulation while maximizing display area. In particular, the display system is preferably formed of corrugated paperboard and comprises at least one modular tray member. In this embodiment, each system member is substantially identical. Each modular tray member comprises a modular tray having a bottom panel, a back panel and two side panels. Further, each modular tray includes at least one stacking tab for engaging a tab stacking slot on a successively higher one of the modular tray members. In this embodiment, the modular tray has three stacking tabs capable of releasable mating engagement with three tab stacking slots respectively on a successively higher one of the modular tray members.

In this embodiment, the display system includes a base having four flaps which are folded inwardly to form at least a double sidewall support. Moreover, the display system includes a pallet skirt having four flaps for substantially overlapping sides of a pallet when the flaps are articulated. The display system also includes a joiner member capable of releasable mating engagement with at least one modular tray member; to, in turn, lend structural support and stacking strength to the display system and facilitate vertically stackable orientation thereof.

The bottom panel includes a plurality of tab stacking slots capable of releasable mating engagement with a plurality of stacking tabs on a successively higher one of the modular tray members. In this embodiment, each of the side panels includes a side-back flap which co-operates with the back panel to provide structural support to the modular tray. Moreover, the side-back flaps span the entire height of the back panel.

Each of the side panels includes a biasable flap, which, upon articulation, covers the exposed side panel edges of the modular tray. In this embodiment, each biasable flap is substantially triangular, and includes a locking tab for engaging a tab locking slot on the bottom panel to secure the biasable flap therein. Each of the side panels further includes a side-front flap, which, upon articulation and engagement with the front panel, secures the front panel to the side panels.

In this embodiment, each modular tray member includes a front panel. The front panel includes a fold line and at least one locking tab for inward articulation. Once inwardly articulated, the front panel is engaged and secured to the bottom panel. The front panel further includes two locking tabs for engaging two tab locking slots on the bottom panel to secure the front panel therein.

The invention further comprises a method for forming a point-of-purchase display system for shipping and displaying articles therewithin. The method for forming the point-of-purchase display system comprises the steps of: (1) forming a plurality of modular tray members, each modular tray member including an inner liner which includes a tray support member having a middle region and two side regions and a tray divider member for securing and displaying articles therewithin, the tray divider member further including at least one divider panel; and an outer tray that cooperates with the inner liner, the outer tray has a bottom panel, a back panel, and two side panels, the two side panels and the back panel having a height substantially equal to the height of the inner liner to form integrated side and back walls respectively, which provide maximum stacking strength to the plurality of modular tray members, the two side panels include a biasable flap, which, upon articulation, covers the exposed side wall edges of the outer tray and the inner liner, each biasable flap includes a locking tab for engaging a tab locking slot on the bottom panel to secure the biasable flap therein; (2) positioning the outer tray; (3) placing the inner tray into the outer tray; (4) articulating each biasable flap and inserting the locking tabs into the tab locking slots to secure the biasable flaps therein; (5) inwardly articulating the side-front flaps; (6) inwardly articulating the front panel and inserting the locking tabs into the tab locking slots to engage the side-front flaps and to secure the front panel to the bottom panel; and (6) vertically stacking ones of the plurality of modular tray members onto the modular tray member until a desired height is achieved.

DETAILED DESCRIPTION OF THE DISCLOSURE

Figure 1:
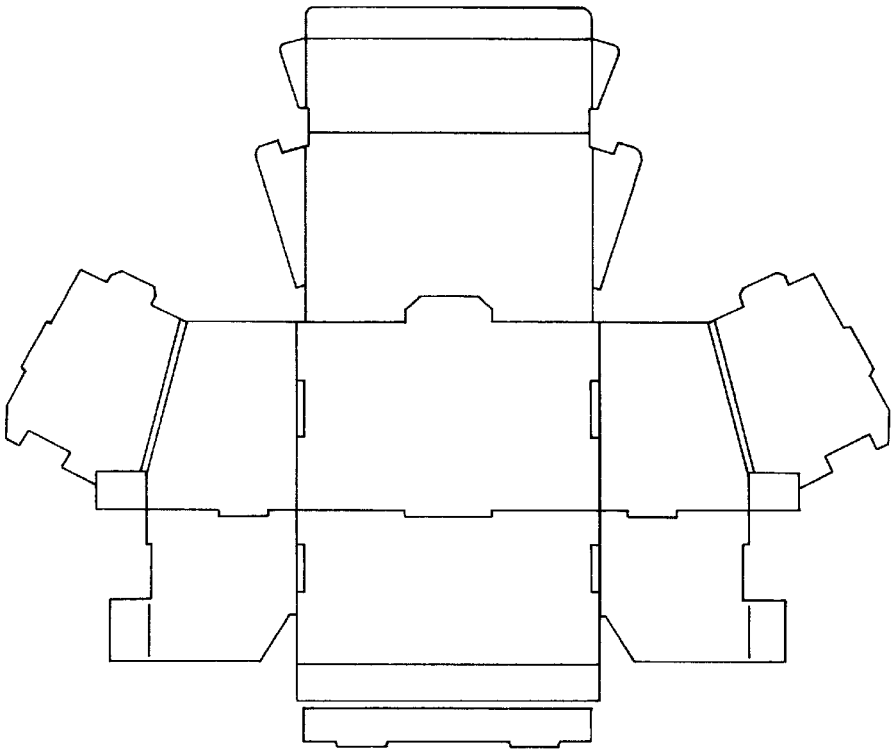
FIG. 1 PRIOR ART
FIG. 1 is a top plan view of a blank for forming a modular tray member according to the prior art.
Figure 2:
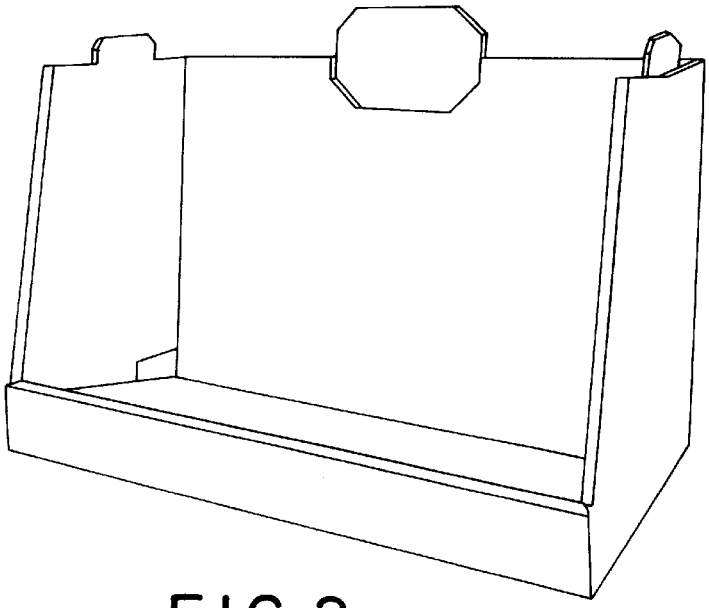
FIG. 2 PRIOR ART
FIG. 2 is a front perspective view of the prior art blank according to FIG. 1.

While this invention is susceptible of embodiment in many different forms, there is shown in the drawings and will be described herein in detail, several specific embodiments, with the understanding that the present invention is to be considered as an exemplification of the principles of the invention and is not intended to limit the invention to the embodiments illustrated.

Figure 20:
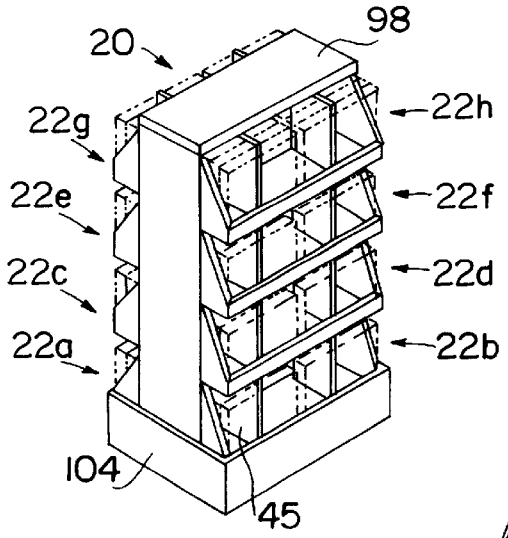
FIG. 20 is a top front perspective view of the display system according to one preferred embodiment of the present invention.

A point-of-purchase display system 20 is shown in FIGS. 20 as comprising at least one modular tray member such as modular tray member 22. Each modular tray member 22 comprises inner liner 24 (see FIG. 4) and outer tray 26 (see FIG. 3). Each modular tray member 22 is preferably constructed of corrugated paperboard. Specifically, inner liner 24 is constructed of B/C flute, and outer tray 26 is constructed of B flute. The use of different materials, such as plastic, among others, along with the use of differently dimensioned blanks, is likewise contemplated. In one preferred embodiment, each modular tray member 22 is substantially identical.

Figure 4:
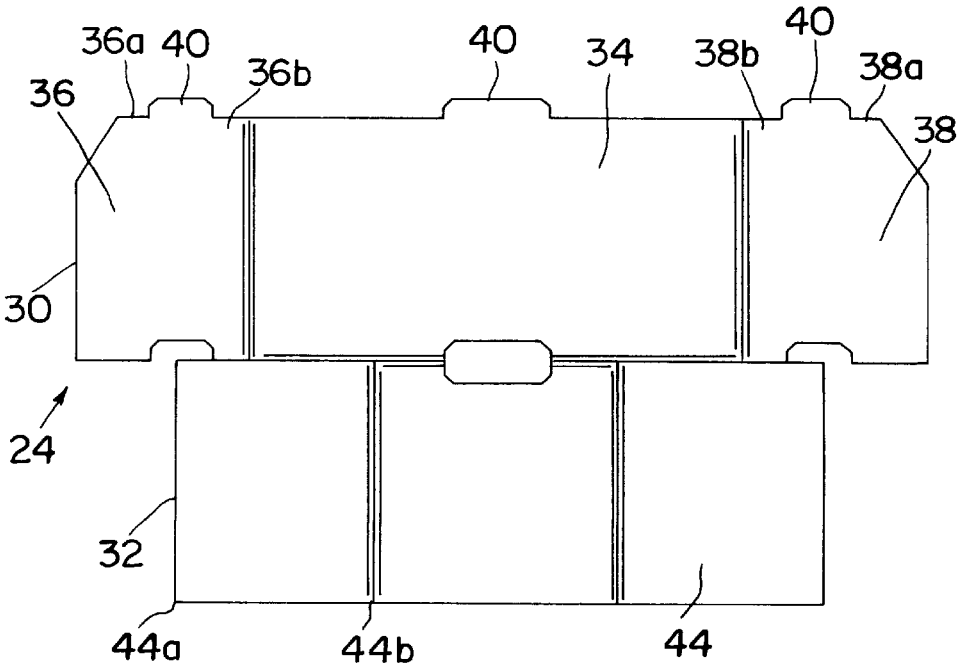
FIG. 4 is a top plan view of a blank for forming the inner liner of the modular tray member according to a preferred embodiment of the present invention.

As shown in FIG. 4, inner liner 24 includes tray support member 30 and tray divider member 32. Tray support member 30 includes middle region 34 and two side regions 36 and 38. Side regions 36 and 38 have front corners 36*a* and 38*a* respectively and back corners 36*b* and 38*b* respectively. In one embodiment, front corners 36*a* and 38*a* are approximately ½" higher than back corners 36*b* and 38*b*. While display system 20 is assembled and subsequently completed, as shown in FIG. 20, four (4) modular tray members 22 are vertically oriented. When modular tray member 22 is vertically loaded with the weight from another modular tray member 22, front corners 36*a* and 38*a* are compressed to substantially the same height as back corners 36*b* and 38*b*.

Tray support member 30 further includes at least one stacking tab 40 for engaging and securing a tab stacking slot 42 (see FIG. 3) on a successively higher one of modular tray member 22. In this embodiment, tray support member 30 has three stacking tabs 40 capable of releasable mating engagement with three tab stacking slots 42 respectively on a successively higher one of modular tray member 22. Tray divider member 32 includes at least one tray divider panel 44 for securing and displaying articles 45 (see FIG. 20) therewithin. In this embodiment, articles 45 are videotapes. Further, tray divider member 32 has two tray divider panels 44.

Tray divider panels 44 have front corners 44*a* and back corners 44*b*. In one embodiment, front corners 44*a* are approximately ½" higher than back corners 44*b*. While display system 20 is assembled and subsequently completed, as shown in FIG. 20, four (4) modular tray members 22 are vertically oriented. When modular tray member 22 is vertically loaded with the weight from another modular tray member 22, front corners 44*a* are compressed to substantially the same height as back corners 44*b*.

Figure 5:
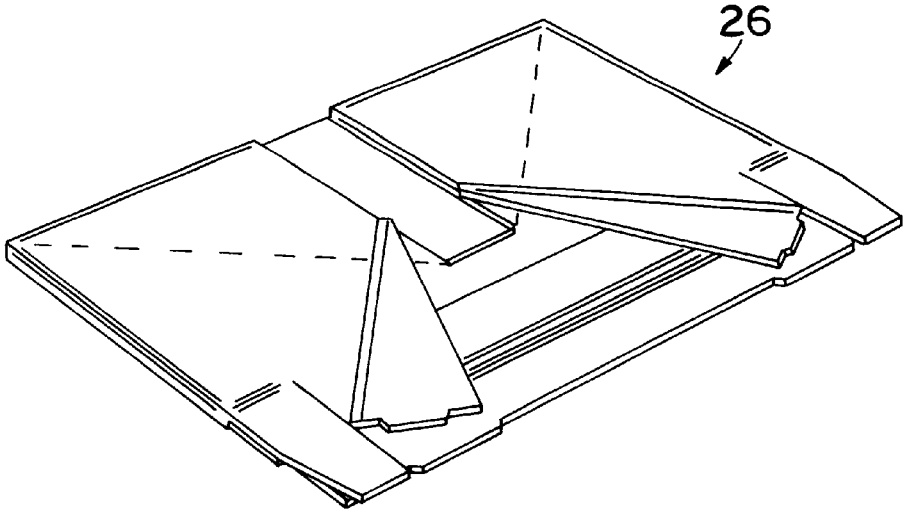
FIG. 5 is a top front perspective view of the outer tray prior to articulation according to FIG. 3.
Figure 6:
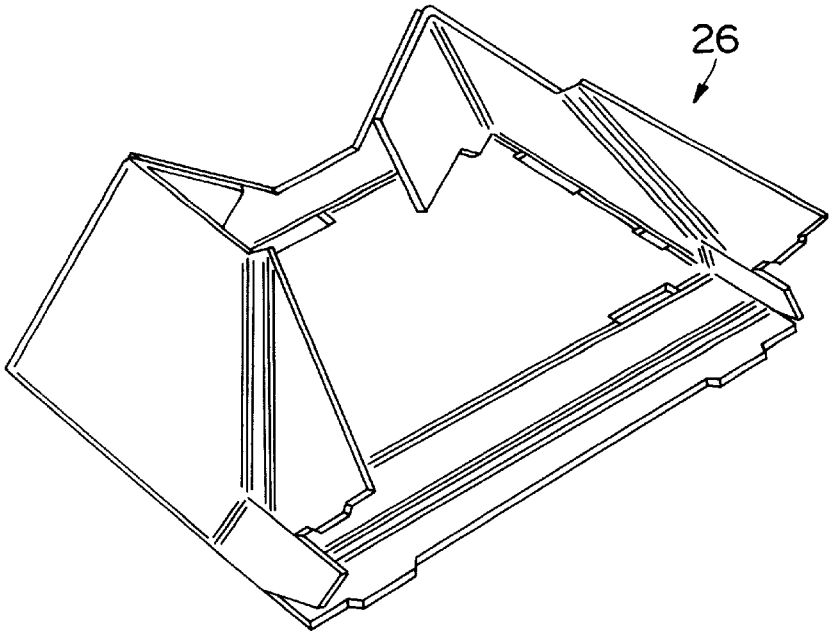
FIG. 6 is a top front perspective view of the outer tray during articulation according to FIG. 3.
Figure 8:
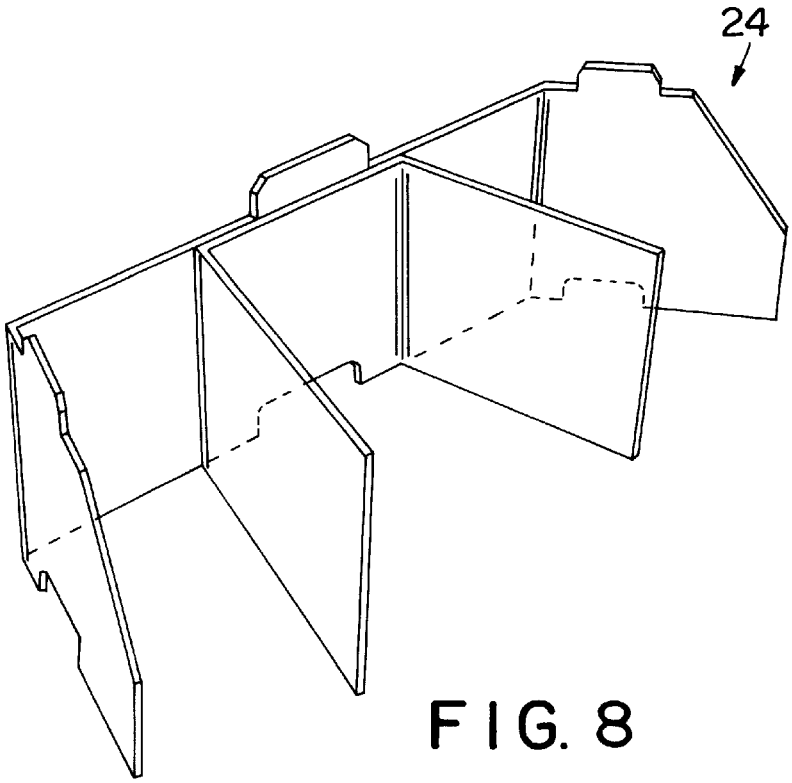
FIG. 8 is a top front perspective view of the inner liner after articulation according to FIG. 4.
Figure 9:
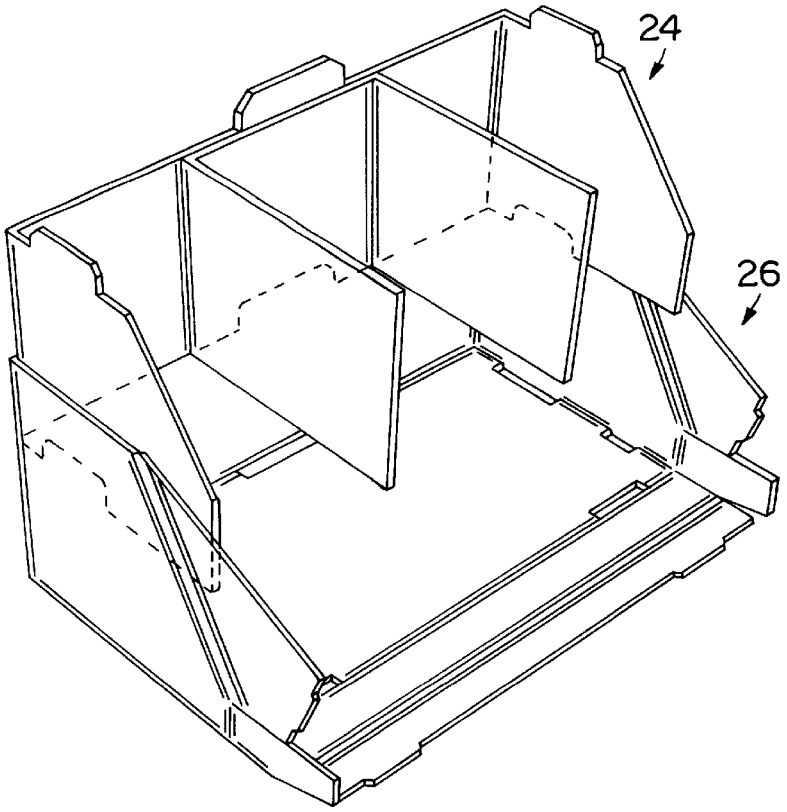
FIG. 9 is a top front perspective view of the modular tray member as the inner liner is inserted into the outer tray member according to FIG. 3.
Figure 10:
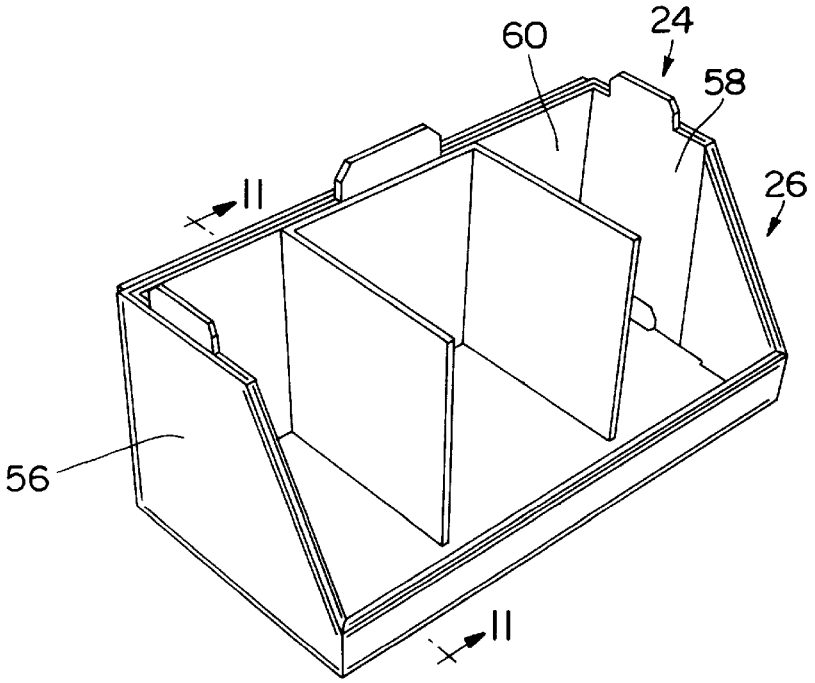
FIG. 10 is a top front perspective view of the modular tray member after the inner liner is inserted into the outer tray member according to FIG. 3.
Figure 11:
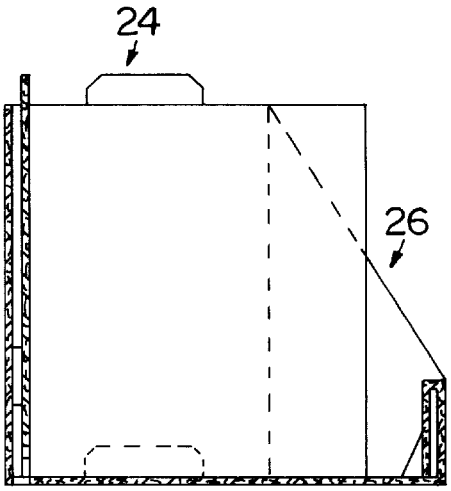
FIG. 11 is a cross-sectional elevated side view of FIG. 10, taken along lines 11—11 and looking in the direction of the arrows.

As shown in FIGS. 9 and 10, outer tray 26 co-operates with inner liner 28 to describe an indexed or divided containment region. Outer tray 26 (see FIG. 7) includes bottom panel 46, back panel 48 and two side panels 50 and 52 respectively. Moreover, as shown in FIGS. 5 and 6, outer tray 26 is self-erecting and collapsible prior to display in a store. In a preferred embodiment, bottom panel 46 includes a plurality of tab stacking slots 42 capable of releasable mating engagement with a plurality of stacking tabs 40 on a successively higher one of modular tray member 22. Back panel 48 includes two angled fold lines 54 (see FIG. 7) which enable back panel 48 to be self-erecting and collapsible. In this embodiment, back panel 48 and side panels 50 and 52 are substantially the same height. Further, panels 48, 50 and 52 have a height substantially equal to the height of inner liner 24. Consequently, inner liner 24 and panels 48, 50 and 52 form integrated side walls 56 and 58 respectively and integrated back wall 60 (see FIG. 10). Accordingly, walls 56, 58 and 60 provide maximum stacking strength to each modular tray member 22.

Figure 3:
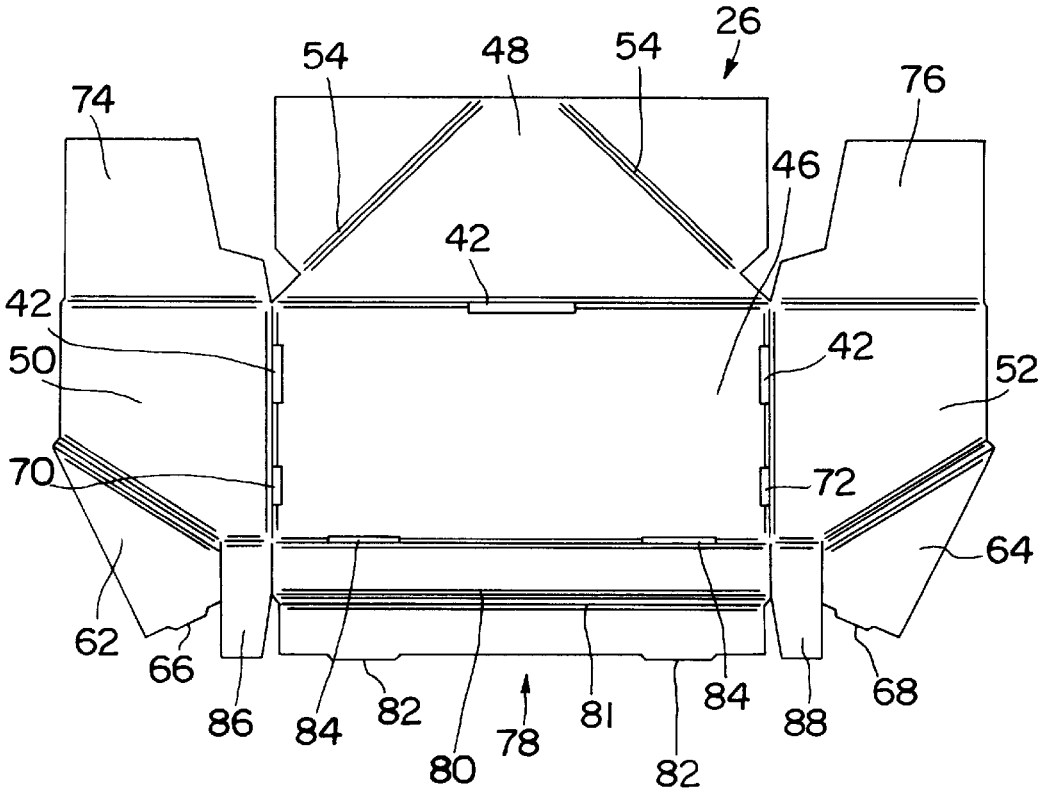
FIG. 3 is a top plan view of a blank for forming the outer tray of the modular tray member according to a preferred embodiment of the present invention.

In one preferred embodiment, and as shown in FIG. 3, side panels 50 and 52 include biasable flaps 62 and 64 which, upon articulation, cover the exposed side wall edges of both outer tray 26 and inner liner 24. In this embodiment, flaps 62 and 64 are substantially triangular. As shown in FIG. 3, flaps 62 and 64 include locking tabs 66 and 68 respectively for operably engaging tab locking slots 70 and 72 respectively on bottom panel 46 to secure flaps 62 and 64 therein. Moreover, side panels 50 and 52 further include side-back flaps 74 and 76 (see FIGS. 3 and 7) respectively, which are operably associated with back panel 48 to provide structural support to outer tray 26.

Figure 7:
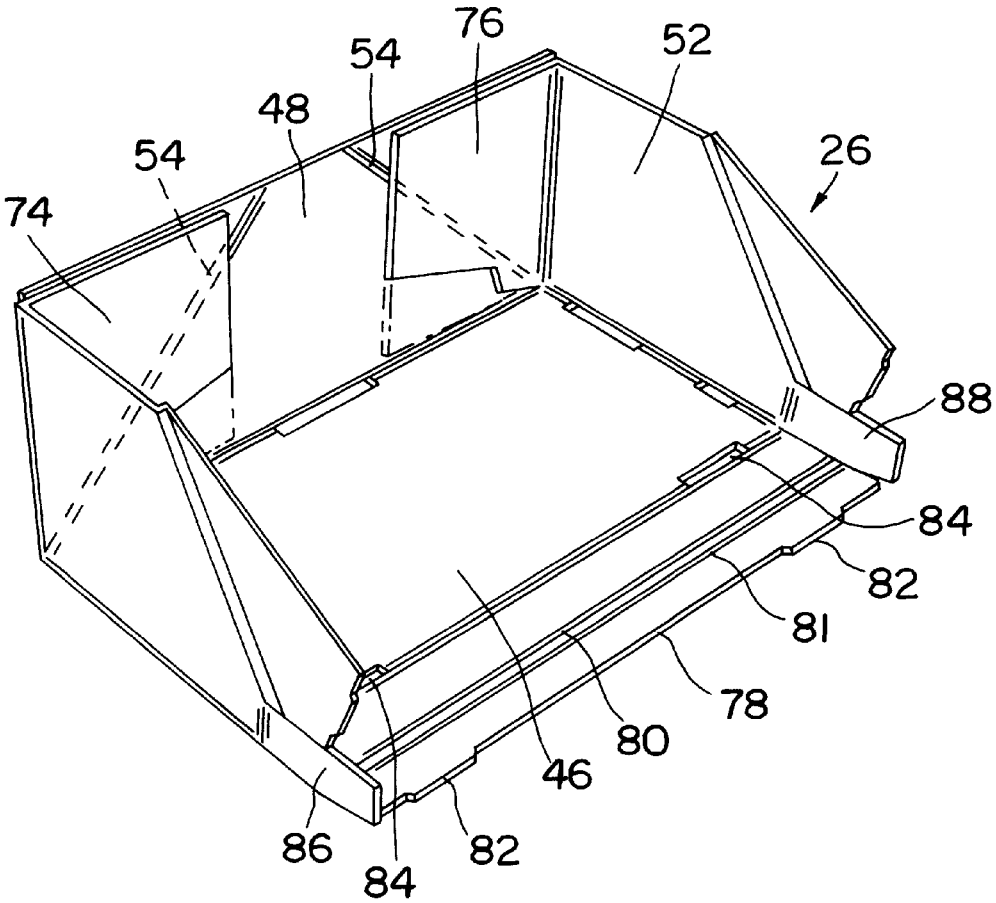
FIG. 7 is a top front perspective view of the outer tray after articulation according to FIG. 3.

As shown in FIGS. 3 and 7, each modular tray member 22 includes front panel 78, which further includes fold lines 80 and 81 and at least one locking tab 82 for inward articulation. Upon inward articulation, front panel 78 engages and secures front panel 78 to back panel 48. In this embodiment, front panel 78 includes two locking tabs 82 for engaging and securing two tab locking slots 84 on bottom panel 46 to secure front panel 78 therein. Moreover, side panels 50 and 52 include side-front flaps 86 and 88, which, upon articulation and operable engagement with front panel 78, secures front panel 78 to side panels 50 and 52.

Figure 15:
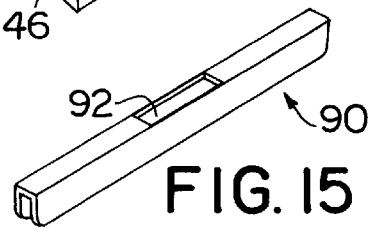
FIG. 15 is a top front perspective view of the joiner member for assembling the display systems of FIGS. 13 and 14.
Figure 16:
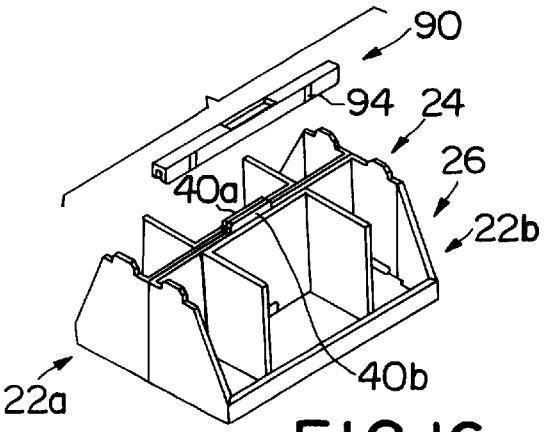
FIG. 16 is a top front perspective view of the joiner member prior to placement between vertical levels of modular tray members constructed according to FIG. 11.
Figure 17:
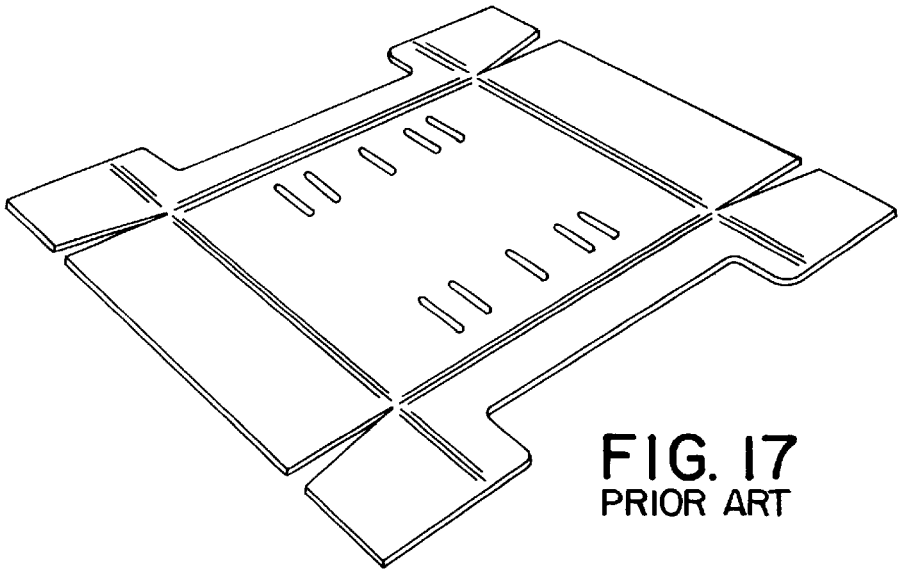
FIG. 17 PRIOR ART
FIG. 17 is a top front perspective view of a blank for forming an outer tray according to the prior art.
Figure 18:
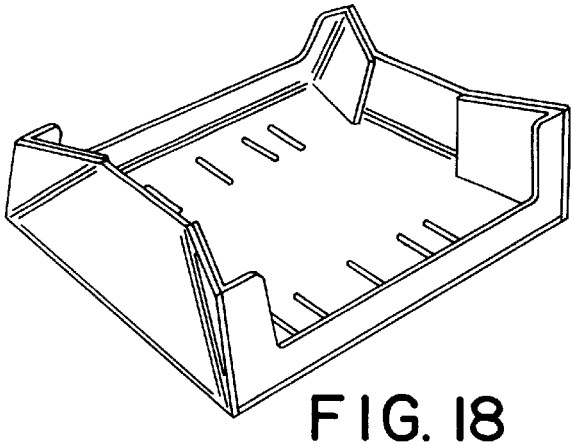
FIG. 18 PRIOR ART
FIG. 18 is a top front perspective view of the outer tray of FIG. 17 during articulation according to the prior art.
Figure 19:
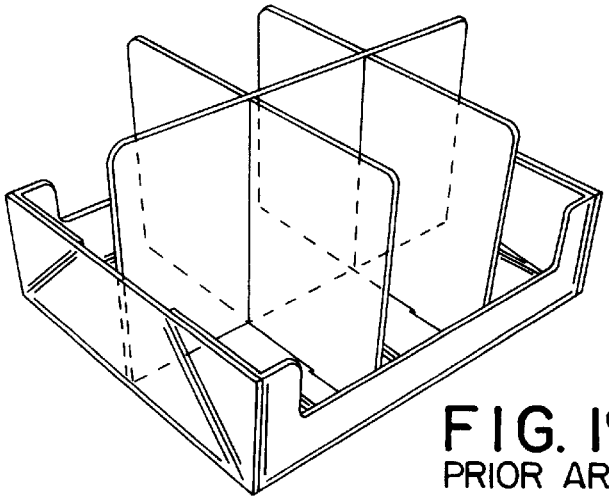
FIG. 19 PRIOR ART
FIG. 19 is a top front perspective view of the modular tray member of FIG. 17 after insertion of the inner liner according to the prior art.

In this embodiment, display system 20 includes base 104 (see FIG. 20) which has four flaps, which are folded inwardly for forming at least a double sidewall support. As shown in FIGS. 15 and 16, display system 20 further includes joiner member 90 capable of releasable mating engagement with at least one modular tray member 22; to, in turn, lend structural support and stacking strength to display system 20 and facilitate vertically stackable orientation thereof. Joiner member 90 has a slot 92 for receiving stacking tab 40 from another modular tray members 22. Additionally, joiner member 90 has two slots 94 for receiving divider panels 44 from another modular tray member 22. In this embodiment, joiner member 90 is placed between the second and third vertical level of modular tray member 22 to provide maximum stacking strength to display system 20.

Figure 13:
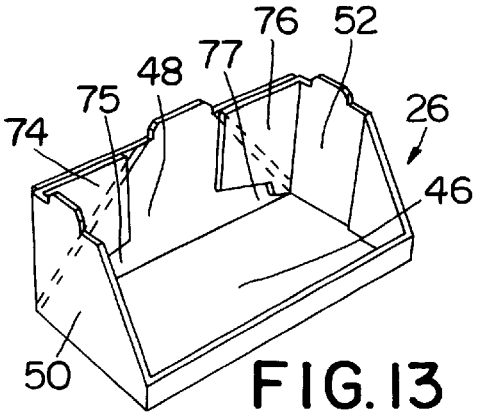
FIG. 13 is a top front perspective view of the modular tray member according to another embodiment of the present invention.

In another embodiment, as shown in FIG. 13, display system 20 comprises at least one modular tray member 22. In this embodiment, each modular tray member 22 comprises a self-erecting, collapsible outer tray 26. Outer tray 26 includes bottom panel 46, back panel 48, side panels 50 and 52, and side-back flaps 74 and 76. Side panels 50 and 52 include biasable flaps 62 and 64 which, upon articulation, cover the exposed side panel edges of outer tray 26. Flaps 62 and 64 further include locking tabs 82 for engaging and securing tab locking slots 84 on bottom panel 46 to secure flaps 62 and 64 therein.

Side-back flaps 74 and 76 include notches 75 and 77 which allow outer tray 26 to be self-erecting and collapsible. Outer tray 26 further includes at least one stacking tab 40 for engaging and securing a tab stacking slot 42 on a successively higher one of modular tray member 22. In this embodiment, outer tray 26 has three stacking tabs 40 capable of releasable mating engagement with three tab stacking slots 42 respectively on a successively higher one of modular tray member 22.

Figure 14:
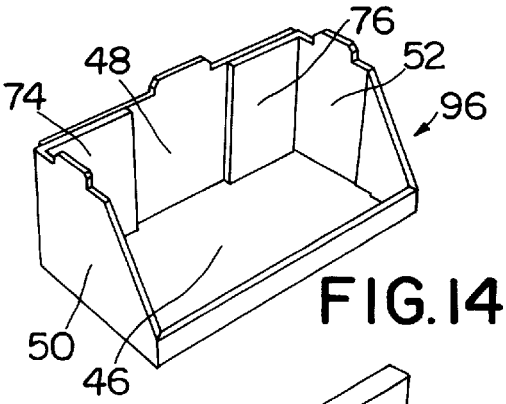
FIG. 14 is a top front perspective view of the modular tray member according to yet another embodiment of the present invention.
Figure 12:
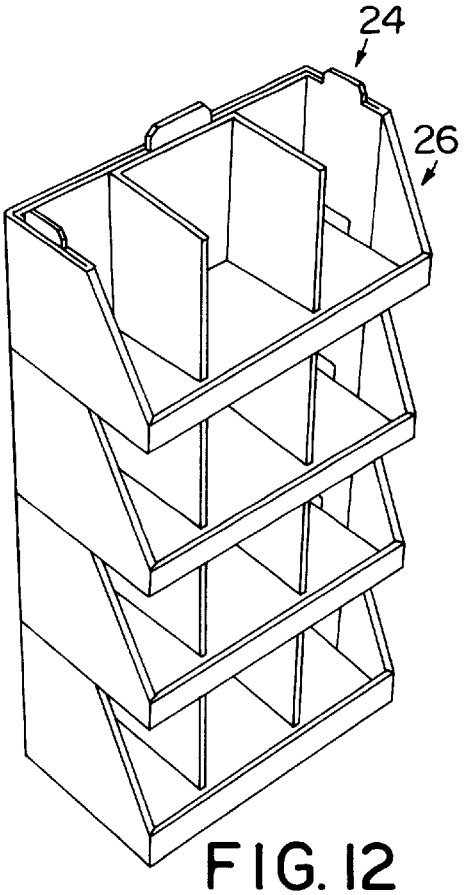
FIG. 12 is a top front perspective view of one display system according to the preferred embodiment of the present invention.

In yet another embodiment, as shown in FIG. 14, display system 20 comprises at least one modular tray member 22. In this embodiment, each modular tray member 22 comprises modular tray 96. Modular tray 96 includes bottom panel 46, back panel 48, side panels 50 and 52, and side-back flaps 74 and 76. Side panels 50 and 52 include biasable flaps 62 and 64 which, upon articulation, cover the exposed side panel edges of the modular tray 96. Flaps 62 and 64 further include locking tabs 82 for engaging and securing tab locking slots 84 on bottom panel 46 to secure flaps 62 and 64 therein.

Side-back flaps 74 and 76 engage bottom panel 46 along the entire width of flaps 74 and 76. Additionally, flaps 74 and 76 are substantially the same height as back panel 48 so as to provide maximum stacking strength to display system 20. Modular tray 96 further includes at least one stacking tab 40 for engaging and securing a tab stacking slot 42 on a successively higher one of modular tray member 22. In this embodiment, modular tray 96 has three stacking tabs 40 capable of releasable mating engagement with three tab stacking slots 42 respectively on a successively higher one of modular tray member 22.

In operation, it must first be determined what size, and how many, articles 45 are to be shipped. Once determined, outer tray 26 is articulated. Next, inner liner 24 is articulated and inserted into outer tray 26 until outer tray 26 and inner liner 24 are in cooperative engagement. Once engaged, tray divider panels 44 are articulated in a position substantially parallel to side panels 50 and 52. Flaps 62 and 64 are then wrapped around portions of side panels 50 and 52 respectively to cover exposed side wall edges of both outer tray 26 and inner liner 24.

Next, locking tabs 66 and 68 are inserted in tab locking slots 70 and 72 on bottom panel to secure side panels 50 and 52 to bottom panel 46. Side-front flaps 84 and 86 are then inwardly articulated along fold line 80, and front panel 78 is inwardly articulated to operably engage side-front flaps 84 and 86. Locking tabs 82 are inserted into tab locking slots 84 on bottom panel 46 to secure front panel 78 therein. Once assembled, at least one modular tray member 22 is shipped to a "duplicator" (manufacturer of videotape copies) for further assembly prior to distribution to the ultimate location, such as a videostore.

Figure 23:
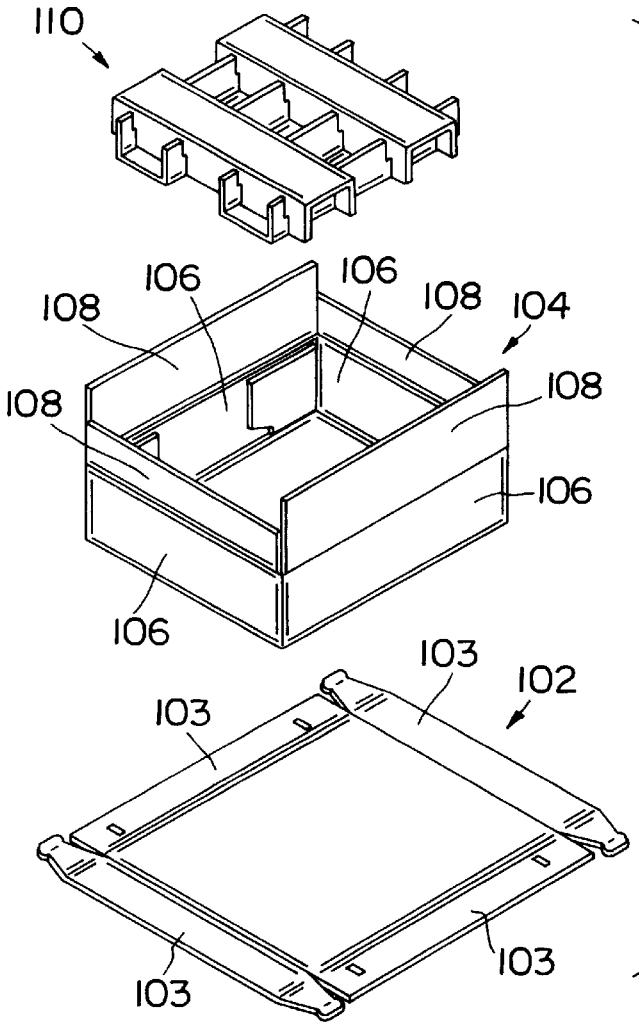
FIG. 23 is a top front perspective view of the base sub assembly according to the preferred embodiment of the present invention.

To finalize assembly of display system 20, a duplicator must first place a pallet skirt 102 on a pallet. As shown in FIG. 23, pallet skirt 102 has four flaps 103 which are articulated to cover the sides of the pallet from the consumer. Base 104 includes base support 106 and flaps 108. Next, base 104 is positioned on pallet skirt 102, and its four flaps 108 are folded inwardly to form at least a double sidewall support. Base support 110 is then placed inside base 104.

In a preferred embodiment, as shown in FIG. 20, eight preassembled modular tray members 22 are needed for assembling display system 20. First, modular tray members 22*a* and 22*b* are placed back-to-back (see FIG. 16) in base 104, so that stacking tab 40*a* is adjacent stacking tab 40*b*. Second, modular tray members 22*c* and 22*d* are placed back-to-back, so that stacking tab 40*c* is adjacent stacking tab 40*d*. Modular tray members 22*c* and 22*d* are then telescopically placed on top of modular tray members 22*a* and 22*b*. Consequently, stacking tabs 40*a* and 40*b* are in releasable mating engagement with tab stacking slots 42*c* and 42*d*. Third, joiner member 90 is telescopically positioned on top of stacking tabs 40*c* and 40*d*, and slot 92 receives stacking tabs 40*c* and 40*d* (see FIG. 16). Moreover, slots 94 receive divider panels 44. Joiner member 92 is then deployed in a position substantially parallel to bottom panel 46, and provides structural support to display system 20.

Fourth, modular tray members 22*e* and 22*f* are placed back-to-back, so that stacking tab 40*e* is adjacent stacking tab 40*f*. Modular tray members 22*e* and 22*f* are then telescopically placed on top of modular tray members 22*c* and 22*d*. Consequently, stacking tabs 40*c* and 40*d* are in releasable mating engagement with tab stacking slots 42*e* and 42*f*. Fifth, modular tray members 22*g* and 22*h* are placed back-to-back, so that stacking tab 40*g* is adjacent stacking tab 40*h*. Modular tray members 22*g* and 22*h* are then telescopically placed on top of modular tray members 22*e* and 22*f*. Consequently, stacking tabs 40*e* and 40*f* are in releasable mating engagement with tab stacking slots 42*g* and 42*h*. Sixth, joiner member 90 is telescopically positioned on top of stacking tabs 40*g* and 40*h*, and slot 92 receives stacking tabs 40*g* and 40*h*. Moreover, slots 94 receive divider panels 44. Joiner member 90 is then deployed in a position substantially parallel to bottom panel 46, and provides structural support to display system 20.

Articles 45 can be positioned in modular tray members 22*a–h* prior to assembly of display system 20, or articles 45 can be positioned in each modular tray member 22 as display system 20 is assembled. Next, the bottoms of two side panels (not shown) are slid into base 104, and the top of the side panels are folded over modular tray members 22*g* and 22*h*. Header cap 98 is then articulated and placed on top of modular tray members 22*g* and 22*h*. Further, shroud (not shown) is wrapped around display system 20, and the flaps of pallet skirt 102 are articulated to cover the sides of the pallet. To complete assembly of display system 20, top cap (not shown) is placed over the shroud. Finally, the duplicator ships display system 20 to the retailer, such as a videostore.

Figure 21:
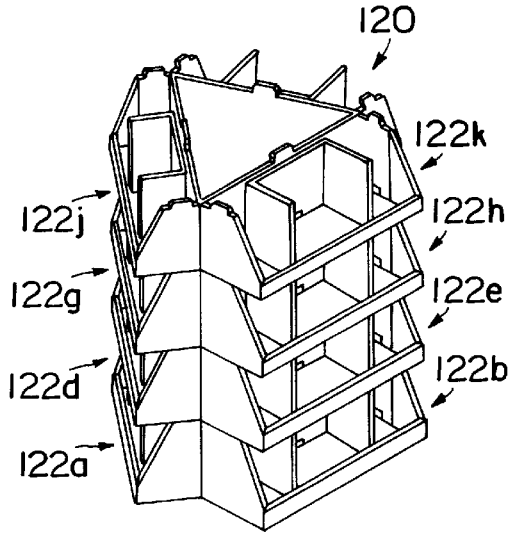
FIG. 21 is a top front perspective view of the display system according to another embodiment of the present invention.
Figure 24:
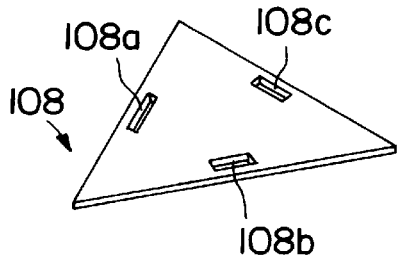
FIG. 24 is a top front perspective view of the locking plate of the display system according to FIG. 21.

Although one preferred embodiment of the invention contemplates a two column display system 20 (see FIG. 20), according to another embodiment of the invention (see FIG. 21), a three column display system 120 is likewise contemplated. As shown in FIG. 21, twelve preassembled modular tray members 122*a–l* are needed for assembling display system 120. In this embodiment, modular tray members 122*a–c* comprise the first vertical level of display system 120. Likewise, modular tray members 122*d–f* comprise the second vertical level of display system 120. A substantially flat, triangular sheet ("locking plate") 108 (see FIG. 24) may be placed between the second and third vertical levels of display system 120 to lock the columns, at their tabs, into fixed orientation. Locking plate 108 has three tab stacking slots 108*a–c* that maintain releasable mating engagement with stacking tabs 140*d–f* and provide structural support to display system 120. The third and fourth vertical levels of display system 120 are assembled in the same fashion as the first and second vertical levels.

Figure 22:
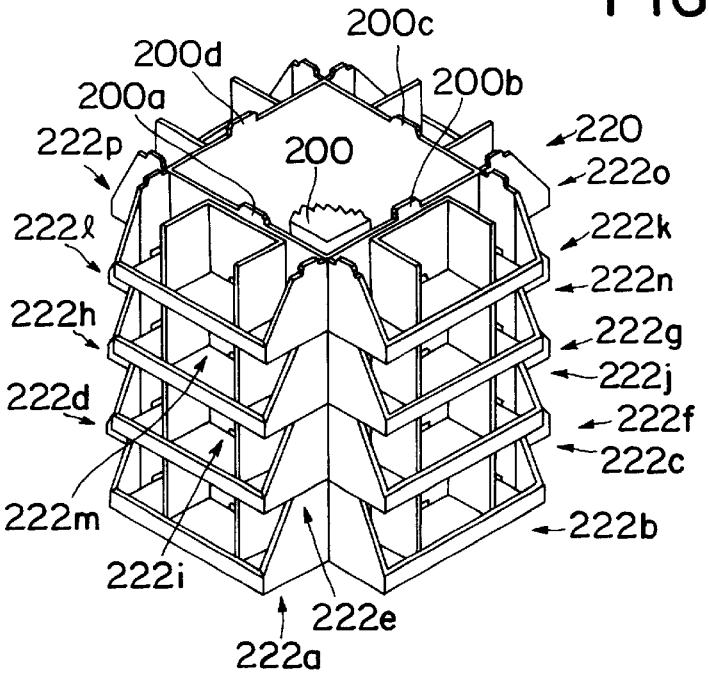
FIG. 22 is a top front perspective view of the display system according to yet another embodiment of the present invention.
Figure 25:
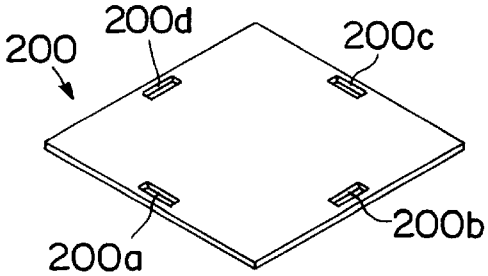
FIG. 25 is a top front perspective view of the locking plate of the display system according to FIG. 22.

It is further contemplated that a four column display system 220 be assembled. As shown in FIG. 22, sixteen preassembled modular tray members 222*a–p* are needed for assembling display system 220. In this embodiment, modular tray members 222*a–d* comprise the first vertical level of display system 220. Likewise, modular tray members 222*e–h* comprise the second vertical level of display system 220. A substantially flat, rectangular sheet ("locking plate") 200 (see FIG. 25) is placed between the second and third vertical levels of display system 220 to lock the columns, at their tabs, into fixed orientation. Locking plate 200 has four tab stacking slots 200*a–d* that maintain releasable mating engagement with stacking tabs 240*e–h* and provide structural support to display system 220. The third and fourth vertical levels of display system 220 are assembled in the same fashion as the first and second vertical levels.

Once shipped to the retailer, display system 20 is disassembled and displayed in the store as either a two, three or four column display. It is also contemplated that a single modular tray member 22 may be placed on a countertop, or other area, to display articles 45, such as videotapes, in a store. Moreover, display system 20 may possess only one title or a veritable plethora of titles. Additionally, articles 45 may be either "tapes" or "clams", depending on the title being displayed and the retailer's choice.

The invention further comprises a method for formation of a point-of-purchase display system for displaying articles therewithin, which utilizes facilitated articulation and maximizes display area. The method comprises the steps of: (1) forming a plurality of modular tray members, each modular tray member comprising a bottom panel, said bottom panel having a plurality of tab locking slots, and further having a plurality of tab stacking slots; a back panel, said back panel having at least one stacking tab and at least two angled fold lines which enable said back panel to be semi-articulated and collapsible; two side panels, each side panel having at least one stacking tab and a biasable flap, which, upon articulation, covers the exposed side wall edges of the modular tray member, each biasable flap includes a locking tab for operably engaging a tab locking slot on the bottom panel to secure the biasable flap therein, each side panel further including a side-front flap; and a front panel, said front panel having at least one fold line and at least one locking tab for inward articulation; (2) articulating the modular tray member; (3) articulating each biasable flap and inserting the locking tabs into the tab locking slots to secure the biasable flaps therein; (4) inwardly articulating the side-front flaps; (5) inwardly articulating the front panel and inserting the locking tabs into the tab locking slots to operably engage the side-front flap and to secure the front panel to the bottom panel; (6) vertically stacking another of the plurality of modular tray members to an existing modular tray member; and (7) repeating the step of vertically stacking until a desired height is achieved.

The foregoing description and drawings merely explain and illustrate the invention, and the invention is not limited thereto except insofar as the appended claims are so limited, as those skilled in the art who have the disclosure before them will be able to make modifications and variations therein without departing from the scope of the invention.

We claim:

1. A point-of-purchase display system for shipping and displaying articles therewithin, the display system utilizes facilitated articulation while maximizing display area, the display system comprising:

at least one modular tray member;

said at least one modular tray member including an inner liner which includes a tray support member having a middle region, at least one side region, said at least one side region having an exposed side wall edge, and a tray divider member for securing and displaying articles therewithin, the tray divider member further including at least one divider panel; and an outer tray operably associated with the inner liner, the outer tray having a bottom panel, a back panel, and at least one side panel;

said at least one side panel and said back panel of the outer tray having a height substantially equal to the height of the inner liner to form integrated side and back walls respectively, to impart additional stacking strength to the at least one modular tray member; and said at least one side panel including at least one biasable flap, which, upon articulation, covers the exposed side wall edge of said inner liner, said at least one biasable flap including a locking tab for operably engaging a tab locking slot on the bottom panel to secure the biasable flap therein.

2. The system according to claim 1 wherein the tray support member further includes at least one stacking tab for operably engaging a tab stacking slot on a successively higher one of said at least one modular tray member.

3. The system according to claim 2 including a base having four flaps, said flaps being folded inwardly to form at least a double sidewall support.

4. The system according to claim 2 wherein the outer tray is self-erecting and collapsible.

5. The system according to claim 2 wherein the at least one modular tray member includes a front panel, the front panel further includes a fold line and at least one locking tab for inward articulation, said at least one locking tab operably engaging and securing the front panel to the bottom panel.

6. The system according to claim 5 wherein the front panel includes two locking tabs for operably engaging two tab locking slots on the bottom panel to secure the front panel therewithin.

7. The system according to claim 2 wherein the bottom panel includes a plurality of tab stacking slots capable of releasable mating engagement with a plurality of stacking tabs on a successively higher one of said at least one modular tray member.

8. The system according to claim 2 wherein the back panel includes two angled fold lines which enable said back panel to be self-erecting and collapsible.

9. The system according to claim 2 wherein the tray support member has three stacking tabs capable of releasable mating engagement with three tab stacking slots respectively on a successively higher one of said at least one modular tray member.

10. The system according to claim 5 wherein the at least one side panel includes a side-front flap, said flap, upon articulation and operable engagement with the front panel, securing the front panel to the at least one side panel.

11. The system according to claim 2 wherein the at least one side panel further includes a side-back flap, said side-back flap being operably associated with the back panel, and provides structural support to the outer tray.

12. The system according to claim 2 wherein the tray divider member includes two tray divider panels.

13. The system according to claim 2 including a joiner member capable of releasable mating engagement with the at least one modular tray member; to, in turn, lend structural support and stacking strength to the display system and facilitate vertically stackable orientation thereof.

14. The system according to claim 2 wherein the at least one modular tray member is substantially identical.

15. The system according to claim 2 wherein the articles are videotapes.

16. The system according to claim 2 wherein the at least one modular tray member is a substantially flat blank.

17. The system according to claim 2 wherein the at least one modular tray member is formed of paper material.

18. The system according to claim 2 wherein the at least one modular tray member is formed of corrugated paperboard.

19. A point-of-purchase display system for shipping and displaying articles therewithin, the display system employing facilitated articulation while maximizing display area, the display system comprising:

at least one modular tray member;

said at least one modular tray member including a self-erecting, collapsible outer tray having a bottom panel, a back panel, and at least one side panel, said at least one side panel having an exposed side panel edge;

said at least one side panel including a biasable flap, which, upon articulation of a portion of said at least one side panel over a remaining portion of said at least one side panel, conceals said at least one exposed side panel edge of the outer tray, said biasable flap including a locking tab for operably engaging a tab locking slot on the bottom panel to secure the biasable flap therein; and said outer tray being substantially self-erecting and collapsible upon articulated orientation of at least a portion of said at least one side panel relative to said back panel.

20. A point-of-purchase display system for shipping and displaying articles therewithin, the display system employing facilitated articulation while maximizing display area, the display system comprising:

at least one modular tray member:

said at least one modular tray member including a self-erecting, collapsible outer tray having a bottom panel, a back panel, and at least one side panel, said at least one side panel having an exposed side panel edge:

said at least one side panel including a biasable flap, which, upon articulation of a portion of said at least one side panel over a remaining portion of said at least one side panel, conceals said at least one exposed side panel edge of the outer tray, said biasable flap including a locking tab for operably engaging a tab locking slot on the bottom panel to secure the biasable flap therein; and said outer tray being substantially self-erecting and collapsible upon articulated orientation of at least a portion of said at least one side panel relative to said back panel; and the outer tray further includes at least one stacking tab for operably engaging a tab stacking slot on a successively higher one of the at least one modular tray member.

21. The system according to claim 20 including a base having four flaps, said flaps being folded inwardly to form at least a double sidewall support.

22. The system according to claim 20 wherein the at least one modular tray member includes a front panel, the front panel further includes at least one fold line and at least one locking tab for inward articulation, said at least one locking tab operably engaging and securing the front panel to the bottom panel.

23. The system according to claim 22 wherein the front panel includes two locking tabs for operably engaging two tab locking slots on the bottom panel for securing the front panel therein.

24. The system according to claim 20 wherein the bottom panel includes a plurality of tab stacking slots capable of releasable mating engagement with a plurality of stacking tabs on a successively higher one of said at least one modular tray member.

25. The system according to claim 20 wherein the back panel includes two angled fold lines which enable said back panel to be self-erecting and collapsible.

26. The system according to claim 20 wherein the outer tray has three stacking tabs capable of releasable mating engagement with three tab stacking slots respectively on a successively higher one of said at least one modular tray member.

27. The system according to claim 20 wherein the at least one modular tray member is substantially identical.

28. The system according to claim 20 wherein the articles are videotapes.

29. The system according to claim 22 wherein the at lease one side panel includes a side-front flap, said front flap, upon articulation, operably engaging with the front panel, to secure the front panel to the at least one side panel.

30. The system according to claim 20 wherein the at least one side panel further includes a side-back flap, said side-back flap being operably associated with the back panel, and providing structural support to the outer tray.

31. The system according to claim 20 including a joiner member capable of releasably and matingly engaging with the at least one modular tray member; to, in turn, lend structural support and stacking strength to the display system and to facilitate vertically stackable orientation thereof.

32. The system according to claim 20 wherein the at least one modular tray member is a substantially flat blank.

33. The system according to claim 20 wherein the at least one modular tray member is formed of paper material.

34. The system according to claim 20 wherein the at least one modular tray member is formed of corrugated paperboard.

35. A point-of-purchase display system for shipping and displaying articles therewithin, the display system utilizing facilitated articulation while maximizing display area, the display system comprising:

at least one modular tray member;

said at least one modular tray member including a modular tray having a bottom panel, a back panel, and at least one side panel, said at least one side panel having an exposed side panel edge;

said at least one side panel including a side-back flap, said side-back flap providing substantial structural support to the back panel of the modular tray and being operably associated with the back panel, to substantially span and reinforce the height of the back panel; and said at least one side panel including a biasable flap, which, upon articulation, conceals said at least one exposed side panel edge of the modular tray, said biasable flap including a locking tab for operably engaging a tab locking slot on the bottom panel to secure the biasable flap therein.

36. The system according to claim 35 wherein the at least one modular tray further includes at least one stacking tab for operably engaging a tab stacking slot on a successively higher one of said at least one modular tray member.

37. The system according to claim 35 including a base having four flaps, said flaps being folded inwardly to form at least a double sidewall support.

38. The system according to claim 35 wherein the at least one modular tray member includes a front panel, the front panel further includes at least one fold line and at least one locking tab for inward articulation, said at least one locking tab operably engages and secures the front panel to the bottom panel.

39. The system according to claim 38 wherein the front panel includes two locking tabs for operably engaging two tab locking slots on the bottom panel to secure the front panel therein.

40. The system according to claim 35 wherein the bottom panel includes a plurality of tab stacking slots capable of releasable mating engagement with a plurality of stacking tabs on a successively higher one of said at least one modular tray member.

41. The system according to claim 35 wherein the modular tray has three stacking tabs capable of releasable mating engagement with three tab stacking slots respectively on a successively higher one of said at least one modular tray member.

42. The system according to claim 35 wherein the at least one modular tray member is substantially identical.

43. The system according to claim 35 wherein the articles are videotapes.

44. The system according to claim 38 wherein the at least one side panel includes a side-front flap, said flap, upon articulation and operable engagement with the front panel, secures the front panel to the at least one side panel.

45. The system according to claim 35 including a joiner member capable of releasable mating engagement with at least one modular tray member; to, in turn, lend structural support and stacking strength to the display system and facilitate vertically stackable orientation thereof.

46. The system according to claim 35 wherein the at least one modular tray member is a substantially flat blank.

47. The system according to claim 35 wherein the at least one modular tray member is formed of paper material.

48. The system according to claim 35 wherein the at least one modular tray member is formed of corrugated paperboard.

49. A method for forming a point-of-purchase display system for shipping and displaying articles therewithin, the display system utilizing facilitated articulation while maximizing display area, the method for forming said point-of-purchase display system comprising the steps of:

forming a plurality of modular tray members, each modular tray member including an inner liner which includes a tray support member having a middle region, at least one side region, said at least one side region having an exposed side wall edge, and a tray divider member for securing and displaying articles therewithin, the tray divider member further including at least one divider panel; and an outer tray operably associated with the inner liner, the outer tray having a bottom panel, a back panel, and at least one side panel, said at least one side panel and said back panel having a height substantially equal to the height of the inner liner to form integrated side and back walls respectively, to impart additional stacking strength to the plurality of modular tray members, said at least one side panel including at least one biasable flap, which, upon articulation, covers the exposed side wall edge of said inner liner, said at least one biasable flap includes a locking tab for operably engaging a tab locking slot on the bottom panel to secure the biasable flap therein;

positioning the outer tray;

placing the inner tray into said outer tray;

articulating each biasable flap and inserting the locking tabs into the tab locking slots to secure the biasable flaps therein;

inwardly articulating the side-front flaps;

inwardly articulating the front panel and inserting the locking tabs into the tab locking slots to operably engage the side-front flaps and to secure the front panel to the bottom panel; and vertically stacking ones of said plurality of modular tray members onto the modular tray member until a desired height is achieved.

* * * * *